US006721992B2

(12) United States Patent
Cotton

(10) Patent No.: US 6,721,992 B2
(45) Date of Patent: Apr. 20, 2004

(54) BOAT HINGE COVER

(76) Inventor: Oren Cotton, P.O. Box 729, East Sound, WA (US) 98245

( * ) Notice: Subject to any disclaimer, the term of this patent is extended or adjusted under 35 U.S.C. 154(b) by 0 days.

(21) Appl. No.: 10/175,436

(22) Filed: Jun. 19, 2002

(65) Prior Publication Data

US 2003/0233731 A1 Dec. 25, 2003

(51) Int. Cl.[7] ..... E05D 11/00
(52) U.S. Cl. ..... 16/251; 16/250; 16/372
(58) Field of Search ..... 16/250, 251, 372

(56) References Cited

U.S. PATENT DOCUMENTS

| | | | | | |
|---|---|---|---|---|---|
| RE16,187 | E | * | 10/1925 | Soss | 16/372 |
| 3,665,552 | A | | 5/1972 | Toldo et al. | |
| 3,768,117 | A | | 10/1973 | Toldo et al. | |
| 4,656,691 | A | | 4/1987 | Allen | |
| 4,796,330 | A | * | 1/1989 | Ziegler | 16/251 |
| 4,802,259 | A | * | 2/1989 | Geslewitz | 16/251 |
| 4,878,267 | A | * | 11/1989 | Roach et al. | 16/250 |
| 5,001,862 | A | * | 3/1991 | Albenda | 16/251 |
| 5,056,191 | A | * | 10/1991 | Love | 16/251 |
| 5,224,240 | A | * | 7/1993 | Smith et al. | 16/251 |
| 5,339,493 | A | | 8/1994 | MacIntyre | |
| 5,432,979 | A | * | 7/1995 | Harper | 16/251 |
| 5,520,479 | A | | 5/1996 | Hernandez | |
| 5,722,120 | A | * | 3/1998 | Bindschatel et al. | 16/250 |
| 5,765,263 | A | * | 6/1998 | Bolinas et al. | 16/250 |
| 6,276,026 | B1 | * | 8/2001 | Wille | 16/250 |

FOREIGN PATENT DOCUMENTS

| | | |
|---|---|---|
| DE | 197 57 213 | 2/1999 |
| EP | 0 259 618 | 3/1988 |
| EP | 0 387 207 | 9/1990 |
| EP | 0824177 | 2/1998 |
| EP | 098 73 93 | 3/2000 |
| EP | 1067266 | 1/2001 |
| GB | 2262119 | 6/1993 |
| WO | WO 99/18316 | 4/1999 |

* cited by examiner

*Primary Examiner*—Lloyd A. Gall
*Assistant Examiner*—Christopher Boswell
(74) *Attorney, Agent, or Firm*—Andrew W. Ludy

(57) ABSTRACT

A hinge cover is for use in connection with a hinge having a pivotal axis and typically two leaves penetrated by fasteners with heads. The hinge cover comprises a plate covering the leaf The plate is attached either to the hinge or to the fastener heads with an adhesive pad having a pressure-sensitive adhesive surface. The plate has a skirt projecting outward from the plate lower surface, so as to cover the leaf edges and the leaf distal end.

10 Claims, 1 Drawing Sheet

BOAT HINGE COVER

FIELD OF THE INVENTION (1) This invention relates to the field of hinges, and more particularly to a hinge leaf cover for covering the hinge leaf, and hiding from view fasteners used to attach the hinge.

BACKGROUND OF THE INVENTION (2) Hinges are used in a wide variety of applications, including high end products such as boats, wherein attractive appearance is paramount. The heads of fasteners, such as screws, present an unsightly appearance for such products. Certain consumer product applications have safety requirements, as well. Heads of screws may have burrs and sharp edges projecting outward. Such burrs and edges can splinter or cut a hand or foot placed thereupon. This is a consideration on a boat, where people often walk on deck barefoot. Another problem with such exposed fasteners is security. They can easily be loosened to gain access to a locked compartment. Of paramount importance in manufacturing a product is fast and easy assembly of the parts using unskilled labor and no assembly components or tools.

(3) One solution to these problems is to cover the hinge leaf with a plate. Such covers are known, and have taken a variety of configurations. Some hinge covers in the prior art are shown in the following patents:

(4) Chung, WO 99/18316, discloses a cover plate that slides upward into grooves in the leaf when the door is partially open. In the fully open or closed position, the cover cannot be removed because the lower leaf closes off the end of one groove.

(5) Brotschi, EP 0 259 618, employs a cover plate with screws to secure the leaf to a base plate.

(6) Pacini, EP 0 387 207, shows a cover plate, one edge of which is inserted into a groove in the leaf, and the other edge snaps down into another groove. A projecting tab on the plate inner surface fits between two mounting screws to prevent sliding the cover off.

(7) Robins, GB 2 262 119, teaches a security lock mounted in a hinge leaf, which is attached to an access door. A cover plate keeps dirt and water out of the lock. The cover pivots on the hinge axis and is secured by a releasable latch.

(8) Toldo, U.S. Pat. No. 3,768,117, discloses a cover integral with the leaf, joined thereto by a flexible hinge along one edge. The opposite edge has a snap closure.

(9) Toldo, U.S. Pat. No. 3,665,552, discloses a cover similar to the above invention, with a central snap closure tab.

(10) Beyer, DE 197 57 213, depicts a cover, engaging a hole in the hinge leaf by means of a hook.

(11) Sinsteden, EP 0 824 177, shows a hinge with leaves and having covers set into pockets in the leaves.

(12) Hernandez, U.S. Pat. No. 5 520 479, discloses a hinged locking hasp with leaves and a cover, in the form of a box, welded to a post.

(13) MacIntyre, U.S. Pat. No. 5,339,493, discloses a hinge leaf mounted to a cover plate for adjustment with screws. The cover plate is mounted on the door with screws.

(14) Allen, U.S. Pat. No. 4,656,691, shows a hinge leaf that doubles back upon itself to form a pocket, into which the cover is inserted with the door open. Closing the door prevents the cover from being removed.

(15) Kraemer, EP 1 067 266, teaches a cover sliding into grooves in a hinge leaf. Assembling the leaves together holds the cover in place.

(16) Lueffe, EP 0 987 393, discloses a hinge leaf adjustable between an inner plate and an outer cover plate. Screws fasten the cover plate and inner plate to the doorjamb.

(17) None of the above-described inventions having a separate cover employs a skirt around the cover to shield the edge of the leaf and to shed water. In none of the prior art inventions is the cover attached with an adhesive. Brotschi, MacIntyre, and Lueffe attach the cover to the leaf with screws. Pacini, Toldo, and Beyer use snaps or hooks to attach the cover to the leaf. Chung, Pacini, Sinsteden, MacIntyre, and Kraemer require pockets or grooves in the leaf to mount the cover to the leaf

(18) Accordingly, there is a need to provide a cover for a hinge leaf that will provide fast and easy assembly of the cover to the leaf.

(19) There is a further need to provide a cover of the type described and that will hide the fastener heads from view, and show an attractive finished surface.

(20) There is a yet further need to provide a cover of the type described and that will shield burrs and sharp edges for safety.

(21) There is a still further need to provide a cover of the type described and that will provide a measure of security for locked compartments.

(22) There is an additional need to provide a cover of the type described and that can be manufactured cost-effectively in large quantities of high quality.

SUMMARY OF THE INVENTION

(23) In accordance with the present invention, there is provided a boat hinge cover, for use in connection with a boat hinge assembly on a boat. The hinge has a pivotal axis and at least one leaf. The leaf extends between a proximal end adjacent the pivotal axis and a distal end, and extends between opposite right and left edges. The hinge assembly includes the hinge and at least one fastener penetrating the leaf, the fastener having a head. The hinge cover comprises a plate extending between opposite first and second ends, and extending between opposite right and left edges. The plate has opposite upper and lower surfaces. The plate covers the leaf and the fastener head. The plate first end is juxtaposed with the leaf proximal end. The plate second end is juxtaposed with the leaf distal end. The plate right and left edges are juxtaposed with the leaf right and left edges respectively. A skirt extends along the plate right and left edges and the plate second end. The skirt projects outward from the plate lower surface, so as to cover the leaf right and left edges and the leaf distal end, and to allow water to drain from between the leaf and the plate. An adhesive is provided on the plate lower surface for attaching the plate to the leaf. The hinge cover is water-shedding so as to allow water to drain from between the leaf and the plate.

BRIEF DESCRIPTION OF THE DRAWING

(24) A more complete understanding of the present invention may be obtained from consideration of the following description in conjunction with the drawing, in which.

DESCRIPTION OF THE PREFERRED EMBODIMENTS

Figure 5:
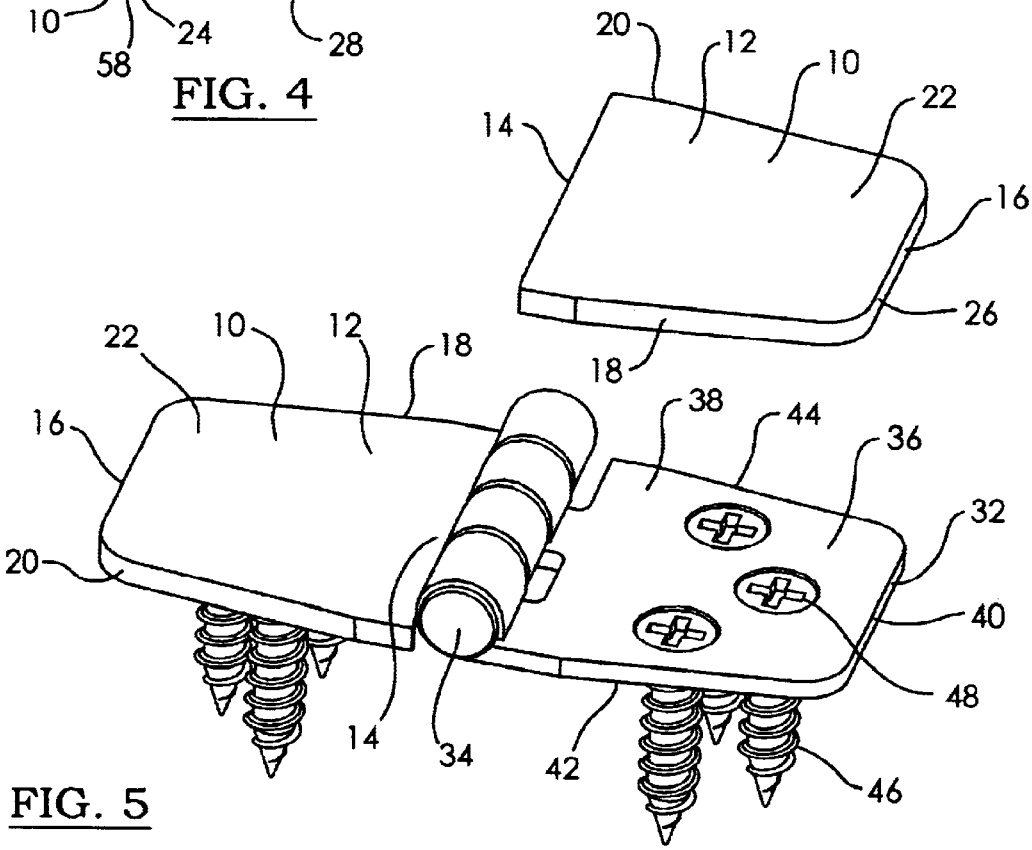
FIG. 5 is an exploded perspective view of a hinge showing fasteners penetrating both leaves, and with the hinge cover of FIG. 1 installed on one leaf, and the hinge cover of FIG. 1 juxtaposed over the other leaf.

(25) Referring now to the drawing, a hinge cover 10 is for use in connection with a hinge assembly 11 on a boat. The assembly includes a hinge 32, and at least one fastener 46. The hinge 32 has a pivotal axis 34 and at least one leaf 36, and typically two leaves 36, as shown in FIG. 5. Each leaf 36 extends between a proximal end 38 adjacent the pivotal axis 34 and a distal end 40. The leaf 36 extends between opposite right 42 and left 44 edges. The leaf 36 is penetrated by at least one fastener 46, and typically by several fasteners 46, as shown. The fastener 46 is typically a screw or a bolt having a head 48.

(26) The hinge cover 10 comprises a plate 12 extending between opposite first 14 and second 16 ends. The plate 12 extends between opposite right 18 and left 20 edges. The plate 12 has opposite upper 22 and lower surfaces 24. The plate 12 covers the leaf 36 and the fastener head 48. The plate first end 14 is juxtaposed with the leaf proximal end 38. The plate second end 16 is juxtaposed with the leaf distal end 40. The plate right 18 and left 20 edges are juxtaposed with the leaf right 42 and left 44 edges respectively. The plate 12 has a skirt 26 extending along the plate right 18 and left 20 edges and the plate second end 16. The skirt 26 projects outward from the plate lower surface 24, so as to cover the leaf right 42 and left 44 edges and the leaf distal end 40, and to allow water to drain from between the leaf 36 and the plate 12, and also to make it difficult to pry the hinge cover off with a screwdriver or a knife. The plate 12 typically is made from stainless steel, or molded from plastic.

Figure 1:
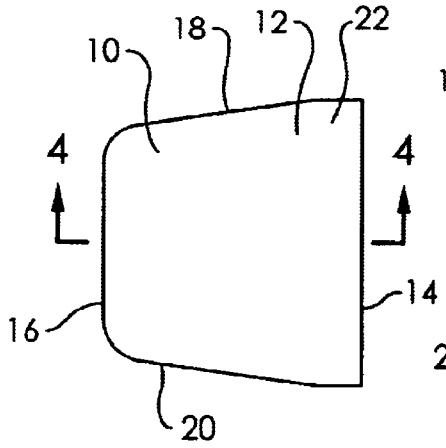
FIG. 1 is a top view of a hinge cover constructed in accordance with the invention.
Figure 2:
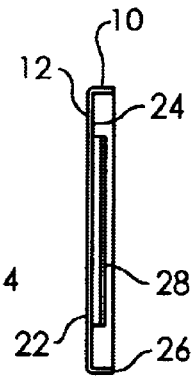
FIG. 2 is an end view of the hinge cover of FIG. 1.
Figure 3:
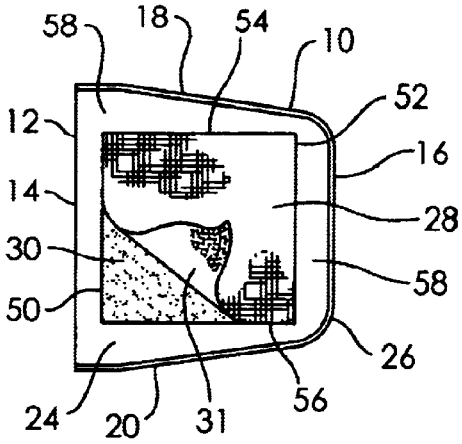
FIG. 3 is a bottom view of the hinge cover of FIG. 1.
Figure 4:
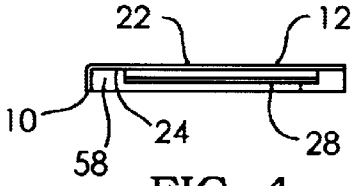
FIG. 4 is a cross-sectional side view of the hinge cover of FIG. 1, taken along lines 4—4 of FIG. 1.

(27) An adhesive 30 is provided for attaching the plate 12 to the leaf 36 and to the fastener head 48. The adhesive 30 includes a pad 28 attached to the plate lower surface 24, as depicted in FIG. 3. The pad 28 has a pressure-sensitive adhesive surface 30. The pad 28 extends from a pad first edge 50 adjacent the plate first end 14 to a pad second edge 52 adjacent the plate second end 16. The pad 28 extends from a pad right edge 54 adjacent the plate right edge 18 to a pad left edge 56 adjacent the plate left edge 20. The spacing between the pad 28 and the skirt 26 forms a vent cavity 58 around at least three edges of the pad 28, and preferably around all edges. This allows water to drain from between the leaf 36 and the plate 12, and allows air to circulate between the leaf 36 and the plate 12 for drying. Typically, the pressure-sensitive adhesive surface 30 will include a peel-off layer 31 to protect the adhesive.

(28) In practice, the hinge 32 is mounted in place with the fasteners 46. The peel-off layer 31 is removed, and the hinge cover 10 is positioned over the leaf 36. Downward force is then applied to secure the hinge cover 10 to the leaf 36 with the adhesive pad 28.

(29) A hinge covering method is disclosed for covering the hinge 32. The method comprises the steps of providing a plate 12 for the hinge cover 10, providing an adhesive 30 on the plate 12 for the hinge cover 10, then attaching the plate 12 to the hinge leaf 36 with the adhesive 30. Next, shedding water from the hinge cover 10, and allowing the water to drain from between the leaf 36 and the plate 12.

(30) Further steps include projecting a skirt 26 outward from a lower surface 24 of the plate 12, then covering an edge 42 and 44 of the leaf 36 with the skirt 26.

(31) Yet further steps include circumscribing the pad 28 with a vent cavity 58 between the pad 28 and the skirt 26, then allowing water to drain from between the leaf 36 and the plate 12 through the vent cavity 58, and allowing air to circulate between the leaf 36 and the plate 12 through the vent cavity 58 for drying.

(32) Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

What is claimed is:

1. A boat hinge cover, for use in connection with a boat hinge assembly on a boat, the hinge having a pivotal axis and at least one leaf, the leaf extending between a proximal end adjacent the pivotal axis and a distal end, the leaf extending between opposite right and left edges, the hinge assembly including the hinge and at least one fastener penetrating the leaf, the fastener having a head, the hinge cover comprising:

(a) a plate extending between opposite first and second ends, the plate extending between opposite right and left edges, the plate having opposite upper and lower surfaces, the plate covering the leaf and the fastener head, the plate first end juxtaposed with the leaf proximal end, the plate second end juxtaposed with the leaf distal end, the plate right and left edges juxtaposed with the leaf right and left edges respectively;

(b) a skirt extending along the plate right and left edges and the plate second end, the skirt projecting outward from the plate lower surface, so as to cover the leaf right and left edges and the leaf distal end, and to allow water to drain from between the leaf and the plate; and (c) an adhesive on the plate lower surface for attaching the plate to the leaf, the hinge cover being water-shedding so as to allow water to drain from between the leaf and the plate.

2. The hinge cover of claim 1, wherein the adhesive includes a pad attached to the plate lower surface, the pad having a pressure-sensitive adhesive surface, the pad extending from a pad first edge adjacent the plate first end to a pad second edge adjacent the plate second end, the pad extending from a pad right edge adjacent the plate right edge to a pad left edge adjacent the plate left edge, the spacing between the pad and the skirt forming a vent cavity around at least three edges of the pad, so as to allow water to drain from between the leaf and the plate, and to allow air to circulate between the leaf and the plate for drying.

3. The hinge cover of claim 2, wherein the pad includes a peel-off layer attached to the pressure-sensitive adhesive surface, so that the peel-off layer will be removed, the hinge cover will be positioned over the leaf, and downward force will be applied so as to secure the hinge cover to the leaf with the adhesive pad.

4. The hinge cover of claim 3, wherein the hinge assembly and hinge cover are constructed of stainless steel.

5. The hinge cover of claim 3, wherein the hinge assembly and hinge cover are molded from plastic.

6. A boat hinge cover, for use in connection with a boat hinge assembly on a boat, the hinge having a pivotal axis and at least one leaf, the leaf extending between a proximal end adjacent the pivotal axis and a distal end, the leaf extending between opposite right and left edges, the hinge assembly including the hinge and at least one fastener penetrating the leaf, the fastener having a head, the hinge cover comprising:

(a) a plate extending between opposite first and second ends, the plate extending between opposite right and left edges, the plate having opposite upper and lower surfaces, the plate covering the leaf and the fastener head, the plate first end juxtaposed with the leaf proximal end, the plate second end juxtaposed with the leaf distal end, the plate right and left edges juxtaposed with the leaf right and left edges respectively;

(b) a skirt extending along the plate right and left edges and the plate second end, the skirt projecting outward from the plate lower surface, so as to cover the leaf right and left edges and the leaf distal end, and to allow water to drain from between the leaf and the plate; and (c) an adhesive on the plate lower surface for attaching the plate to the leaf, the adhesive including a pad attached to the plate lower surface, the pad having a pressure-sensitive adhesive surface, the pad extending from a pad first edge adjacent the plate first end to a pad second edge adjacent the plate second end, the pad extending from a pad right edge adjacent the plate right edge to a pad left edge adjacent the plate left edge, the spacing between the pad and the skirt forming a vent cavity around at least three edges of the pad, so as to allow water to drain from between the leaf and the plate, and to allow air to circulate between the leaf and the plate for drying, the pad including a peel-off layer attached to the pressure-sensitive adhesive surface, so that the peel-off layer will be removed, the hinge cover will be positioned over the leaf, and downward force will be applied to secure the hinge cover to the leaf with the adhesive pad.

7. The hinge cover of claim 6, wherein the hinge assembly and hinge cover are constructed of stainless steel.

8. The hinge cover of claim 6, wherein the hinge assembly and hinge cover are molded from plastic.

9. A hinge covering method for covering a boat hinge assembly with a hinge cover, the hinge having a pivotal axis and at least one leaf, the hinge assembly including the hinge and at least one fastener penetrating the leaf, the fastener having a head, the method comprising the steps of:

(a) providing a plate for the hinge cover;

(b) projecting a skirt outward from a lower surface of the plate;

(c) covering an edge of the leaf with the skirt;

(d) providing an adhesive between the plate and the hinge cover;

(e) attaching the plate to the hinge leaf with the adhesive;

(f) shedding water from the hinge cover; and (g) allowing the water to drain from between the leaf and the plate.

10. The hinge covering method of claim 9, further comprising the steps of:

(a) forming a vent cavity between the pad and the skirt around at least three edges of the pad;

(b) allowing water to drain from between the leaf and the plate through the vent cavity; and (c) allowing air to circulate between the leaf and the plate through the vent cavity for drying.

* * * * *